US007609984B2

(12) United States Patent
Aoki et al.

(10) Patent No.: US 7,609,984 B2
(45) Date of Patent: Oct. 27, 2009

(54) FIXING DEVICE

(75) Inventors: Kohji Aoki, Nara (JP); Toyoaki Nanba, Osaka (JP); Yoshinobu Tateishi, Nara (JP); Yasuhiro Takai, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 324 days.

(21) Appl. No.: 11/624,725

(22) Filed: Jan. 19, 2007

(65) Prior Publication Data

US 2007/0189786 A1 Aug. 16, 2007

(30) Foreign Application Priority Data

Feb. 14, 2006 (JP) ..... 2006-036889

(51) Int. Cl.
*G03G 15/20* (2006.01)

(52) U.S. Cl. ..... 399/33; 399/69

(58) Field of Classification Search ..... 399/33, 399/69, 31

See application file for complete search history.

(56) References Cited

U.S. PATENT DOCUMENTS

| | | | | |
|---|---|---|---|---|
| 5,046,166 | A * | 9/1991 | Takayanagi | 399/33 |
| 5,276,482 | A * | 1/1994 | Nakanishi | 399/69 |
| 6,185,388 | B1 * | 2/2001 | Yamamoto | 399/69 |
| 6,438,335 | B1 * | 8/2002 | Kinouchi et al. | |
| 6,959,158 | B2 * | 10/2005 | Ohta | 399/69 |
| 7,039,336 | B2 * | 5/2006 | Ohta | 399/69 |
| 7,197,253 | B2 * | 3/2007 | Oyama et al. | 399/33 |
| 2003/0053811 | A1 * | 3/2003 | Takayama | 399/33 |
| 2005/0258158 | A1 * | 11/2005 | Takami et al. | |
| 2006/0002730 | A1 * | 1/2006 | Ohta | 399/69 |
| 2006/0018676 | A1 * | 1/2006 | Ishii | 399/33 |
| 2006/0045550 | A1 * | 3/2006 | Oyama et al. | 399/33 |
| 2006/0088328 | A1 * | 4/2006 | Yoshimura et al. | 399/69 |
| 2006/0233565 | A1 * | 10/2006 | Tamaoki | |
| 2007/0075065 | A1 * | 4/2007 | Miyoshi | |

FOREIGN PATENT DOCUMENTS

| | | | |
|---|---|---|---|
| JP | 59-224884 | | 12/1984 |
| JP | 2000155495 | A * | 6/2000 |
| JP | 2000-227731 | | 8/2000 |
| JP | 2002-156868 | | 5/2002 |
| JP | 2003-255753 | | 9/2003 |
| JP | 2004012823 | A * | 1/2004 |

* cited by examiner

*Primary Examiner*—Susan S Lee
(74) *Attorney, Agent, or Firm*—Renner, Otto, Boisselle & Sklar, LLP

(57) ABSTRACT

The fixing device includes a pair of rotating bodies which conveys a recording medium between a nip; a heating unit which heats at least one of the rotating bodies; and a temperature detection unit which detects a temperature of at least one of the rotating bodies. The temperature detection unit detects a temperature change until an image forming apparatus is normally operated since the heating unit starts the heating, and the temperature change is stored. It is judged that the image forming apparatus is in an abnormal state when the temperature detection unit detects a temperature change different from the temperature change in the normal operation. A temperature control unit stops passage of current through the heating unit when it is judged that the image forming apparatus is in the abnormal state.

11 Claims, 6 Drawing Sheets

FIXING DEVICE

CROSS-REFERENCE TO RELATED APPLICATION

This application is related to Japanese Patent Application No. 2006-036889 filed on Feb. 14, 2006, whose priority is claimed under 35 USC § 119, the disclosure of which is incorporated by reference in its entirety.

BACKGROUND OF THE INVENTION

1. Field of the Invention

The present invention relates to a fixing device used in an image forming apparatus, particularly to the fixing device in which presence or absence of a recording sheet winding around a rotating body is detected in restarting after a jam and the restart can safely be performed.

2. Description of Related Art

For example, Japanese Patent Laid-Open No. 2003-255753 discloses a technique, wherein a noncontact temperature detection unit is provided on the downstream side of a nip portion of a fixing roller, a temperature of a heating roller is controlled by the noncontact temperature detection unit, and it is judged that the jam is generated when the noncontact temperature detection unit detects the temperature lower than the temperature at which the recording sheet passes normally through the nip portion. Japanese Patent Laid-Open No. 2003-255753 also discloses a technique, wherein it is judged that sheet discharge delay jam is generated when the noncontact temperature detection unit detects that the temperature is not lowered even after a predetermined time elapses since the recording sheet enters the nip portion.

According to Japanese Patent Laid-Open No. 2003-255753, the jam can be detected using the noncontact temperature detection unit. Recently, speed-up is increasingly demanded in the image forming apparatus, the recording sheet is inevitably conveyed at high speed and a gap between the recording sheets becomes narrower. For example, the image forming apparatus having performance not lower than 80 sheets per minute or 100 sheets per minute is already developed. In such pieces of high-speed image forming apparatus, when the jam is generated, not only one recording sheet is jammed, but also several recording sheets subsequent to the jammed recording sheet remain in the way of a conveyance path, and sometimes the recording sheet winds around a rotating roller. Accordingly, it is necessary that the jammed recording sheet be removed while all the subsequent recording sheets located in the way of the conveyance path are removed.

In the conventional image forming apparatus, sensors are placed at several points in the way of the conveyance path. After one sensor detects the passage of the recording sheet, when the next sensor detects the passage of the recording sheet within a predetermined time, it is judged that the passage of the recording sheet is normally performed. It is judged that the jam is generated unless the next sensor detects the passage of the recording sheet within the predetermined time. Therefore, the number of jammed recording sheets is not detected and the position of the recording sheet is not correctly detected. Only it is judged that the jammed recording sheet is located between one sensor and the next sensor.

Accordingly, unless a user removes all the jammed recording sheets, sometimes the jam is generated again in restarting the image forming apparatus. Particularly, when the jammed recording sheet is adsorbed to the rotating roller by an adsorption force of toner, sometimes the recording sheet is torn in removing the recording sheet and a part of the torn recording sheet remains adsorbed to the rotating roller. In this state of things, when the image forming apparatus is restarted, the temperature of the rotating roller rises abnormally, which sometimes injures or breaks the rotating roller. When the torn recording sheet remains in the fixing device, there is a risk of breaking a component located in each position of the fixing device or generating positional shift of the component.

SUMMARY OF THE INVENTION

In view of the foregoing problems, an object of the invention is to provide a fixing device in which, in restarting after a jam, the presence or absence of the recording sheet winding around the rotating body can be detected to safely perform the restart.

In order to address the above problems, a fixing device according to the present invention includes: a pair of rotating bodies which conveys a recording medium between a nip at which said rotating bodies are pressed against each other; a heating unit which heats at least one of said rotating bodies; a temperature detection unit which detects a temperature of at least one of said rotating bodies; a storage unit in which a temperature change is stored, said temperature detection unit detecting the temperature change until an image forming apparatus is normally operated since said heating unit starts heating; a judgment unit which judges that the image forming apparatus is in an abnormal state when said temperature detection unit detects a temperature change different from the temperature change of said normal operation; and a temperature control unit which stops passage of current through said heating unit when said judgment unit judges that the image forming apparatus is in the abnormal state.

According to the configuration, in the restart after the jam, the recording sheet winding around the rotating bodies can be detected to prevent overheat of the fixing device.

DESCRIPTION OF THE PREFERRED EMBODIMENTS

Figure 1:
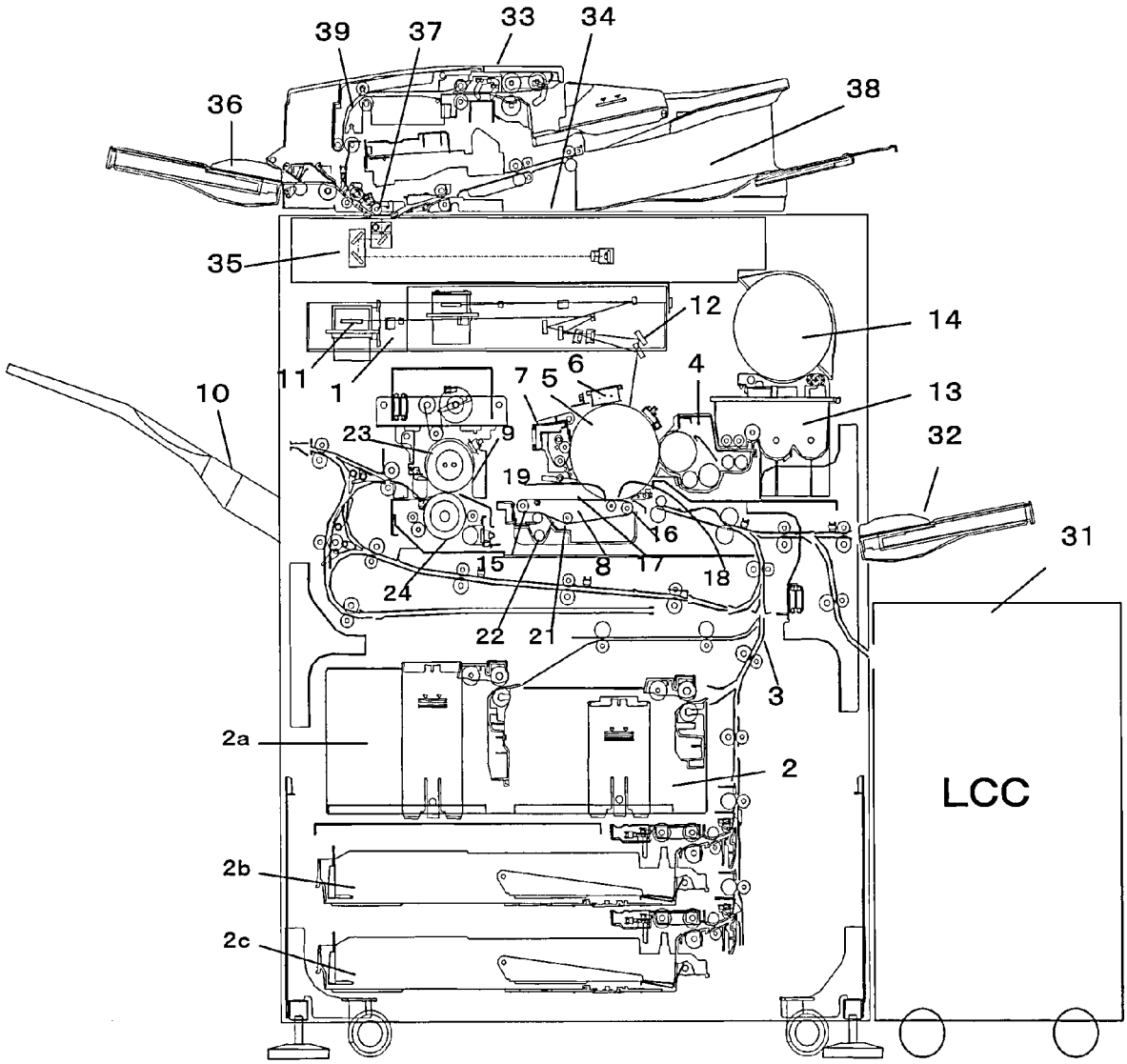
FIG. 1 shows a configuration of an image forming apparatus including a fixing device according to the invention.

It is desirable that the fixing device further includes a drive control unit which stops rotation of said rotating bodies when said judgment unit judges that the image forming apparatus is in the abnormal state. Therefore, the fixing device can safely be stopped.

Further, it is desirable that said temperature detection unit is a noncontact temperature detection unit which is placed near at least one of said pair of rotating bodies. Therefore, the high-speed image forming apparatus can be realized. In addition, the fixing device can be formed while the number of components can be decreased.

Further, it is desirable that said temperature detection unit is arranged in the substantial center of a region where the maximum recording sheet is conveyed between the nip of said pair of rotating bodies. Therefore, in restarting after a jam, one temperature detection unit can detect the presence or absence of the recording sheet winding around the rotating bodies using the one temperature detection unit.

Further, it is desirable that the fixing device further includes a detection unit which is arranged in a sheet non-passing region except for the region where the maximum recording sheet is conveyed between the nip of said pair of rotating bodies. Therefore, the temperature of the rotating bodies can more correctly be detected.

Further, it is desirable that said temperature detection unit causes said temperature control unit to control said rotating bodies based on detection output of said temperature detection unit such that said rotating bodies is maintained at a predetermined temperature. Therefore, the temperature detection unit and the temperature control unit can be used not only in controlling the temperature of the rotating bodies but in detecting the presence or absence of the recording sheet winding around the rotating bodies. Accordingly, the fixing device can be formed while the number of components is decreased.

Further, it is desirable that the fixing device further includes a display unit which displays the abnormality or provides warning when said judgment unit judges that the image forming apparatus is in the abnormal state. Therefore, a user can be informed of the abnormality, or the user can be warned.

Further, it is desirable that the temperature change until the image forming apparatus is normally operated is temperature rise since said heating unit starts the heating again after the rotation of said pair of rotating bodies is stopped to stop the passage of the current through the heating unit. Therefore, the judgment whether or not the recording sheet winds around the rotating bodies can be made.

Further, it is desirable that wherein the temperature rise in the case where the recording sheet winds around the rotating bodies while coming into close contact with the rotating bodies and the temperature rise in the case where the recording sheet winds around the rotating bodies while partially isolated from the rotating bodies are stored in said storage unit. Therefore, the case where the recording sheet winds around the rotating bodies while coming into close contact with the rotating bodies can be distinguished from the case where the recording sheet winds around the rotating bodies while partially isolated from the rotating bodies.

Moreover, the present invention provides an image forming apparatus including a fixing device as described above.

According to the invention, in the restart after a jam, the presence or absence of the recording sheet winding around the rotating bodies can be detected, and the image forming apparatus can safely be restarted. The temperature detection unit which controls the temperature of the heating unit for at least one of the rotating bodies is used as the sensor for detecting the presence or absence of the recording sheet, so that the structure of the fixing device can be simplified.

A preferred embodiment of the invention will be described below with reference to FIG. 1. FIG. 1 shows a configuration of an image forming apparatus including a fixing device according to the embodiment.

The image forming apparatus forms a monochrome image in a predetermined sheet (recording sheet) according to image data transmitted from the outside. Referring to FIG. 1, the image forming apparatus includes an exposure unit 1, a sheet feed tray 2, a sheet conveyance path 3, a development device 4, a photosensitive body 5, a charging device 6, a cleaner unit 7, a transfer mechanism 8, a fixing unit 9, and a sheet discharge tray 10.

As shown in FIG. 1, a laser scanning unit (LSU) including a laser irradiation unit 11 and a reflecting mirror 12 is used as the exposure unit 1. Alternatively a write head in which light emitting elements such as EL and LED are arranged in an array shape may be used as the exposure unit 1. In the image forming apparatus, a technique of utilizing plural laser beams to reduce speed-up of irradiation timing is adopted in order to perform a high-speed printing process. Specifically, a two-beam technique is adopted in the embodiment. The invention is not limited to the two-beam technique, but a one-beam technique in which one laser beam is used may be adopted.

The exposure unit 1 has a function of forming an electrostatic latent image according to a surface of the photosensitive body 5 by exposing the photosensitive body 5, evenly charged by the charging device 6, according to the inputted image data.

The development device 4 visualizes the electrostatic latent image with the toner. A toner tank 13 is provided at the back of the development device 4 to supply toner to the development device 4. A toner bottle 14 is provided to replenish the toner to the toner tank 13. The development device 4 of the embodiment visualizes the electrostatic latent image formed on the photosensitive body 5 with black toner. In the case of the color image forming apparatus, pieces of color toner are prepared.

The charging device 6 is charging means for evenly charging the drum surface constituting the photosensitive body 5 to a predetermined potential. The charger type charging device is used as the charging device 6 in FIG. 1. Alternatively, a roller type or blush type charging device which is of a contact type charging device may be used as the charging device 6.

The cleaner unit 7 removes and recovers the toner remaining on the surface of photosensitive body 5 after development and image transfer.

The transfer mechanism 8 applies an electric field having a reversal polarity of the charge possessed by the electrostatic image onto the conveyed recording sheet, and thereby the electrostatic image visualized on the photosensitive body 5 by the above-described manner is transferred to the recording sheet. For example, when the electrostatic image has the negative-polarity charge, the transfer mechanism 8 applies the electric field having the positive polarity. The transfer mechanism 8 of the image forming apparatus is formed by a transfer belt unit, and the transfer mechanism 8 includes a drive roller 15, a driven roller 16, other rollers, and a transfer belt 17. The transfer belt 17 having a predetermined resistance value (in a range of $1\times10^{9}$ to $1\times10^{13}$ Ω·cm) is entrained about these rollers.

An elastic conductive roller 19 is arranged in a contact portion 18 between the photosensitive body 5 and the transfer belt 17. The transfer electric field can be applied to the elastic conductive roller 19 at the conductivity different from those of the drive roller 15 and driven roller 16. Because the elastic conductive roller 19 has the elasticity, the photosensitive body 5 and the transfer belt 17 are not in linear contact with each other, but the photosensitive body 5 and the transfer belt 17 forms a transfer nip portion having a predetermined width. In the transfer nip portion having the predetermined width, the photosensitive body 5 and the transfer belt 17 are in surface contact with each other, which achieves improvement of transfer efficiency to the conveyed recording sheet.

A neutralizing roller 21 is arranged on the down stream side of the transfer region of the transfer belt 17 while located in the backside of the transfer belt 17. The neutralizing roller 21 eliminates the electric field, applied to the conveyed recording sheet in the transfer region, in order to smoothly convey the recording sheet to the next process. A neutralizing mechanism 22 is arranged in the transfer mechanism 8. The neutralizing mechanism 22 removes the electricity while performing the cleaning for removing toner stain of the transfer belt 17. Examples of the neutralizing mechanism 22 include a technique of connecting to ground through the image forming apparatus and a technique of actively applying the electric field having the polarity the reverse of the transfer electric field.

Figure 2:
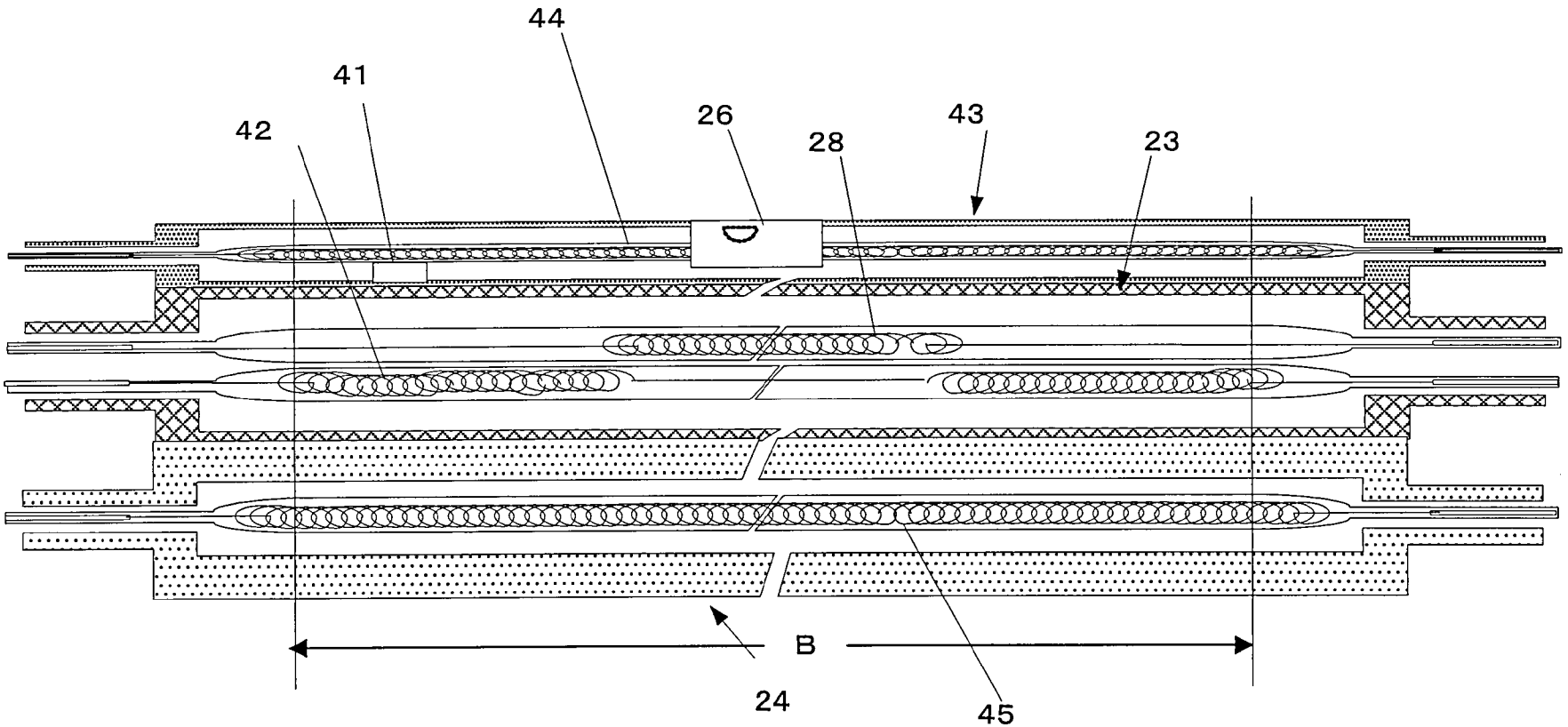
FIG. 2 is a transverse sectional view showing a structure of a fixing unit constituting the fixing device according to the invention.

The electrostatic image (unfixed toner) transferred onto the recording sheet by the transfer mechanism 8 is conveyed to the fixing unit 9, which allows the unfixed toner to be melted and fixed onto the recording sheet. As shown in FIGS. 2 and 3, the fixing unit 9 includes a heating roller 23 and a pressure roller 24. A sheet peeling pawl 25, a roller surface temperature detection member 26 (thermistor), and a roller surface cleaning member 27 are arranged on an outer surface of the heating roller 23. The heating roller 23 has a main heater 28 therein to maintain a heating roller surface at a predetermined temperature (fixing setting temperature substantially ranges from 160 to 200° C.).

On the other hand, a pressure member (not shown) is arranged such that the pressure roller 24 can be pressed against the heating roller 23 with predetermined pressure at both end portions of the pressure roller 24. As with the outer surface of the heating roller 23, a sheet peeling pawl 29 and a roller surface cleaning member (not shown) are arranged on the outer surface of the pressure roller 24.

In the fixing unit 9, the unfixed toner on the conveyed recording sheet is melted at the surface temperature of the heating roller 23 and fixed onto the recording sheet by a pinning effect of the pressure-contact force in a pressure-contact portion 30 (called fixing nip portion) between the heating roller 23 and the pressure roller 24.

The sheet feed tray 2 is a tray in which the sheets (recording sheets) used to form the image. In the image forming apparatus of the embodiment, and the sheet feed tray 2 is provided in a lower portion of the image forming unit. Because the image forming apparatus is designed to perform the high-speed printing process, plural sheet feed trays 2*a*, 2*b*, and 2*c* in which 500 to 1500 regular size sheets can be stored in each tray are arranged in the sheet feed tray 2 provided in the lower portion of the image forming unit. The sheet feed tray 2*a* accommodates A4-size recording sheets. The sheet feed tray 2*b* accommodates B5-size recording sheets, and the sheet feed tray 2*c* accommodates B4-size recording sheets. The sheet feed trays and sheet sizes can arbitrarily be set.

A large-capacity sheet feed cassette 31 and a manual feed tray 32 are arranged in side face of the image forming apparatus. Plural kinds of the sheets and the large number of sheets can be stored in the large-capacity sheet feed cassette 31, and the manual feed tray 32 is mainly used to print an irregular size sheet such as a postcard and a letter size sheet.

The sheet discharge tray 10 is arranged in the side face opposite the manual feed tray 32 of the image forming apparatus. A post-processing apparatus (stapling process, punching process, and the like) and plural-stage sheet discharge trays can also optionally be arranged in place of the sheet discharge tray 10.

In addition, the image forming apparatus includes an automatic original feed mechanism and original pressing device 33. The automatic original feed mechanism and original pressing device 33 presses the original, placed on an original placing stage 34, against the original read surface. A laser scanning mechanism 35 is provided below the original placing stage 34, and the laser scanning mechanism 35 reads the original placed on the original placing stage 34 to perform conversion into an electric signal. The automatic original feed mechanism and original pressing device 33 automatically feeds the original placed on an original tray 36 to an original read unit 37, and the automatic original feed mechanism and original pressing device 33 conveys the original to a sheet discharge tray 38. The automatic original feed mechanism and original pressing device 33 includes an original reversal feed unit 39 to read the backside of the original.

Figure 3B:
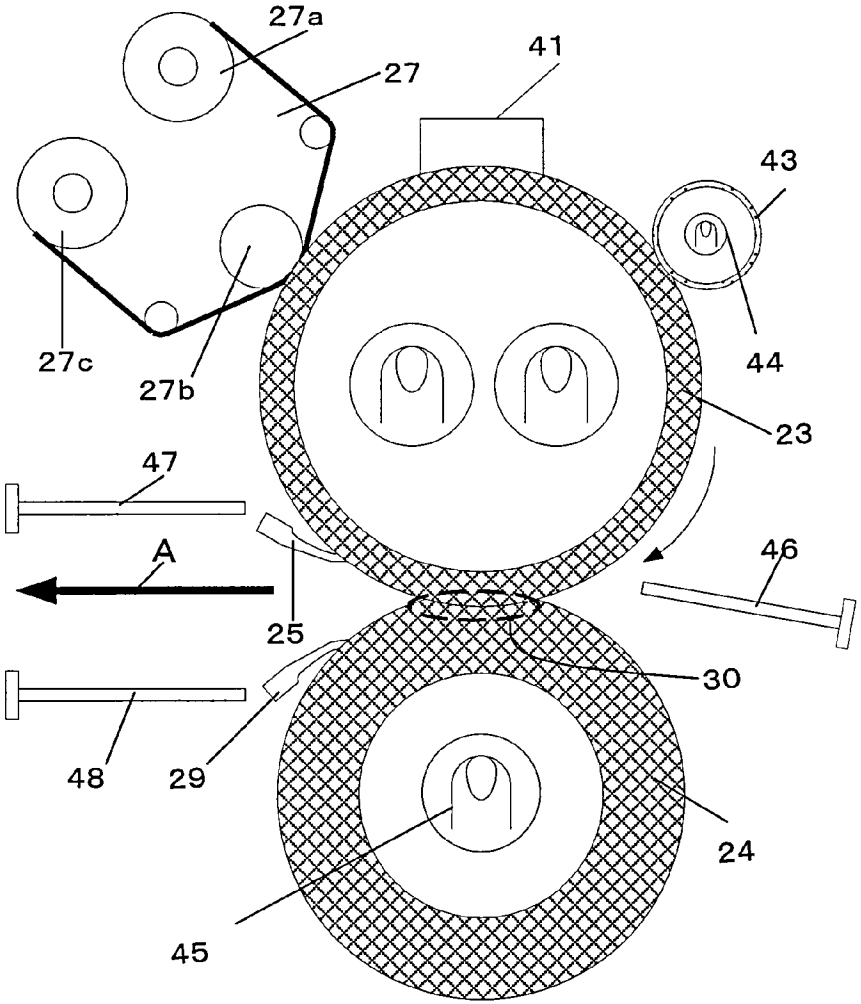
FIG. 3 is a longitudinal sectional view showing the structure of the fixing unit constituting the fixing device according to the invention.
Figure 3A:
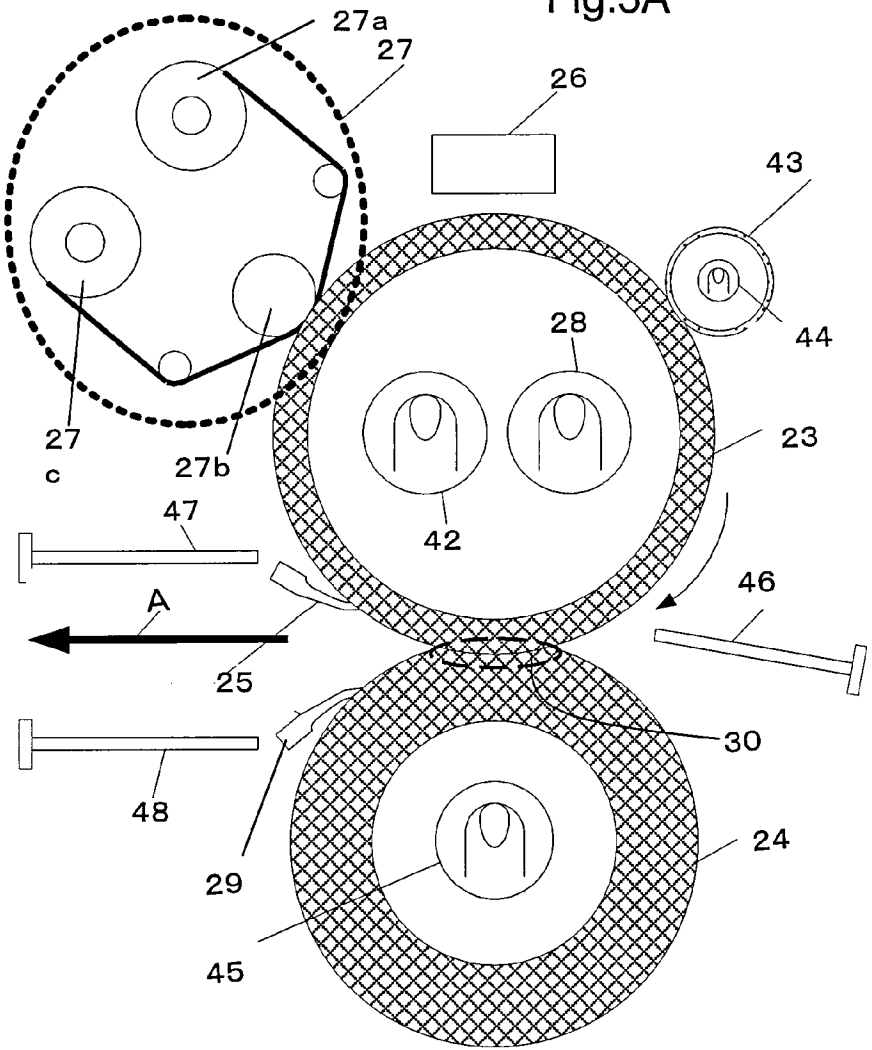

FIG. 2 is a transverse sectional view showing the detailed structure of the fixing unit 9, and FIG. 3 is a longitudinal sectional view showing the detailed structure of the fixing unit 9. FIG. 3A is a sectional view showing a central portion in which the noncontact thermistor 26 is arranged in FIG. 2. FIG. 3B is a sectional view showing an end portion in which a contact thermistor 41 is arranged in FIG. 2. As shown in FIGS. 2 and 3, the main heater 28 and sub-heaters 42 are inserted into the heating roller 23 in non-rotating manner. As shown in FIG. 2, because the image forming apparatus is a central conveyance type, the main heater 28 heats the central portion of the heating roller 23, and the sub-heaters 42 heats the end portions of the heating roller 23. The heating roller 23 is headed from the inside by the main heater 28 and the sub-heaters 42, and the outer surface of the heating roller 23 is heated by an external heating roller 43 which is arranged so as to be in contact with the outer surface of the heating roller 23. An external heating heater 44 is inserted into the external heating roller 43 in the non-rotating manner.

In the monochrome image forming apparatus, the heating roller 23 is made of a metallic material such as iron, and titanium or fluorine is coated on the surface of the heating roller 23 if needed. In the color image forming apparatus, a silicone rubber is coated on the metallic body such as iron, and titanium or fluorine is coated on the surface. The external heating roller 43 formed by a thin roller is arranged near the side of a recording sheet conveyance inlet port, and the external heating roller 43 speeds up the start-up of the image forming apparatus by heating the heating roller 23 from the surface.

Because the noncontact thermistor 26 is arranged in the central portion of the heating roller 23, the noncontact thermistor 26 detects the surface temperature of the heating roller 23 in a noncontact manner, and thereby the noncontact thermistor 26 does not injure the heating roller 23. Because the contact thermistor 41 is arranged in the end portion of the heating roller 23, the contact thermistor 41 does not interrupt the recording sheet conveyed in the central portion, and the contact thermistor 41 correctly detects the surface temperature of the heating roller 23.

The pressure roller 24 is formed by performing the surface coating onto the silicone rubber if needed, and a pressure roller heater 45 is inserted into the pressure roller 24 in the non-rotating manner. The pressure roller heater 45 heats the pressure roller 24 from the inside, the backside temperature of the recording sheet is kept constant at the nip portion 30 to enhance the toner pinning effect, and the unfixed toner is fixed onto the recording sheet.

In FIG. 3A, the recording sheet is conveyed from the transfer mechanism 8 to the nip portion 30 of the fixing unit 9 by a sheet guide 46. After the recording sheet passes through the nip portion 30 of the fixing unit 9, the recording sheet is separated from the heating roller 23 by the sheet peeling pawl 25, or the recording sheet is separated from the pressure roller 24 by the sheet peeling pawl 29. The recording sheet is guided by an upper-side sheet guide 47 and a lower-side sheet guide 48, and the recording sheet is conveyed toward the sheet discharge tray 10 in the direction of the arrow A.

Figure 4:
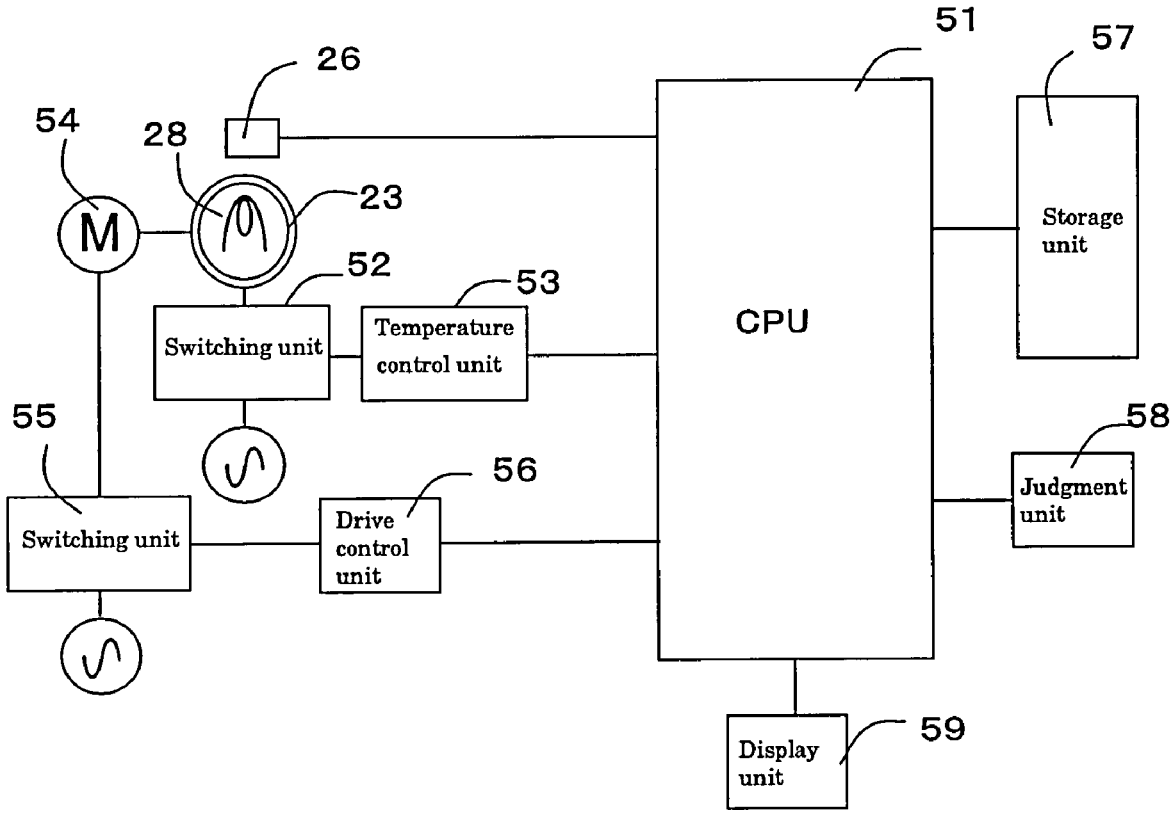
FIG. 4 is a block diagram showing an electric configuration of the image forming apparatus including the fixing device according to the invention.

FIG. 4 is a block diagram showing an electric configuration of the image forming apparatus including the fixing device according to the invention. In FIG. 4, a CPU 51 is a control unit which sequentially executes functions according to a program of the image forming apparatus.

In the embodiment, the image forming apparatus includes a switching unit 52 and a temperature control unit 53. The switching unit 52 connects and disconnects between the main and sub heaters 28 and 42 that heat the heating roller 23 to and from a heating power supply 61. The temperature control unit 53 controls the switching unit 52 based on the temperature detected by the noncontact thermistor 26.

The image forming apparatus also includes a motor 54, a switching unit 55, and a drive control unit 56. The motor 54 rotates the heating roller 23. The switching unit 55 connects and disconnects between the motor 54 and a drive power supply 62. The drive control unit 56 controls the switching unit 55 based on the temperature detected by the noncontact thermistor 26.

The image forming apparatus also includes a storage unit 57, a judgment unit 58, and a display unit 59. When the image forming apparatus detects the jam, the user removes the jammed recording sheet, and then, the image forming apparatus is restarted to heat the heating roller 23 using the main heater 28, the sub-heater 42, and the external heating roller 43. At this point, the temperature rise of the heating roller 23 is stored in the storage unit 57. The judgment unit 58 judges that the image forming apparatus is in the abnormal state when the temperature of the heating roller 23 rises in the way different from the temperature rise stored in the storage unit 57. The display unit 59 displays the jam and the abnormal state or provides the warning of the abnormal state. The above described units are necessary to constitute the fixing device of the invention. Although the image forming apparatus further includes other units, the description of these units will be omitted.

When the judgment unit 58 judges that the image forming apparatus is in the normal state, the temperature control unit 53 turning the switching unit 52 on, and perform the heating by the main heater 28, the sub-heater 42, and the external heater 44. Further, the drive control unit 56 drives the motor 54 by turning the switching unit 55 on. On the other hand, when the judgment unit 58 judges that the image forming apparatus is in the abnormal state, the temperature control unit 53 stops the heating by turning off the main heater 28, the sub-heater 42, and the external heater 44, with the switching unit 52.

The main heater 28, the sub-heater 42, and the external heater 44 may be connected and cut off at the same time or in the sequential manner. The drive control unit 56 stops the drive of the motor 54 by turning off the motor 54 with the switching unit 55. The temperature control unit 53 and the drive control unit 56 may be operated at the same time or in the sequential manner.

Figure 5:
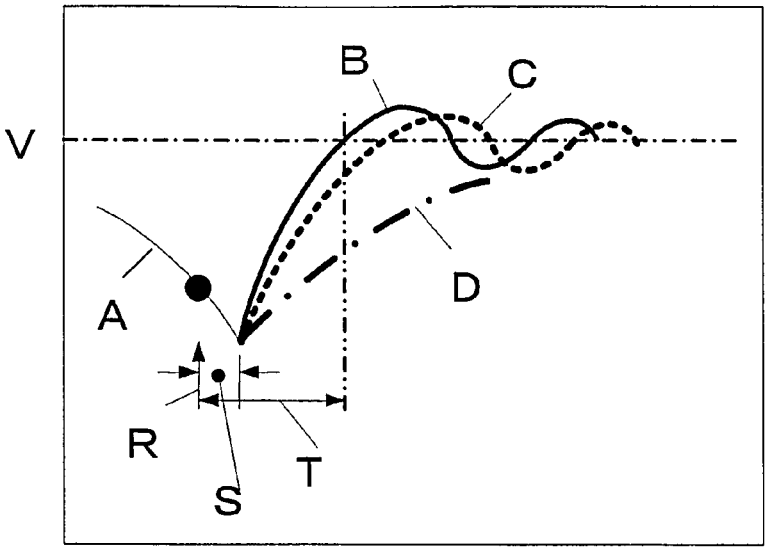
FIG. 5 is a view explaining a temperature curve stored in a storage unit included in the fixing device according to the invention.

FIG. 5 is a view explaining a temperature rise curve stored in the storage unit 57. In FIG. 5, a horizontal axis indicates a time while a vertical axis indicates a temperature, and the temperature curve indicates a temperature change detected by the noncontact thermistor 26. A temperature curve A is one in which the jam is generated the operation of the image forming apparatus is stopped to cut off the passage of the current through the main heater 28, the sub-heater 42, and the external heater 44 which heat the heating roller 23, and the temperature is decreased.

When the jam is generated, the user removes the jammed recording sheet. When, the jammed recording sheet is removed, the conveyance path is accommodated in a predetermined position, and a front door is closed to restart the image forming apparatus. Therefore, the passage of the current through the main heater 28, the sub-heater 42, and the external heater 44 is started. The time at which the passage of the current through the main heater 28, the sub-heater 42, and the external heater 44 is started is indicated by a point R. When a heat conduction time S of the heating roller 23 elapses since the current conduction is started, the rise of the surface temperature is started in the heating roller 23. A temperature curve A which is further decreased even after the current conduction point R as shown by the heat conduction time S indicates that the surface temperature is decreased due to heat capacity of the heating roller 23. A temperature curve B indicates a temperature rise curve when the image forming apparatus is normally restarted.

Figure 6A:
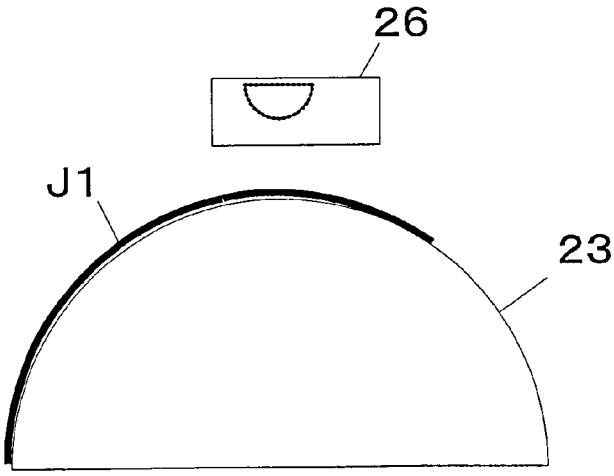
FIG. 6 is a view explaining a state in which a jammed recording sheet winds around a heating roller.

When the recording sheet winds around the heating roller 23, the temperature is changed as shown by a temperature curve C. As shown in FIG. 6A, the temperature curve C shows the case where a recording sheet J1 winds around the heating roller 23 while being in close contact with the heating roller 23 by the adsorption force between the rotating roller and the toner of the jammed recording sheet.

Figure 6B:
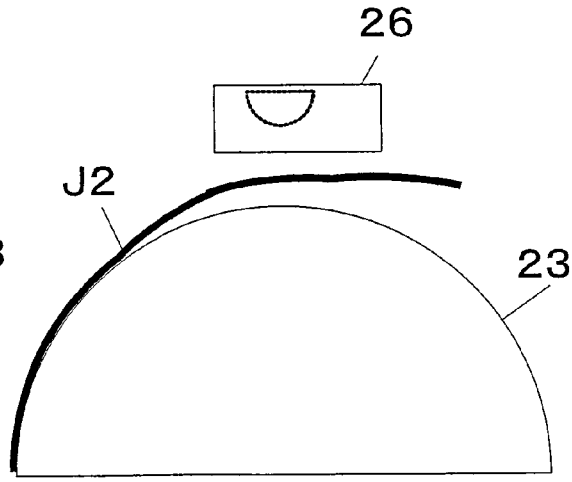

As shown in FIG. 6B, a temperature curve D shows the case where a recording sheet J2 winds around the heating roller 23 while partially isolated from the heating roller 23. In this case, because an air layer is located between the recording sheet and the rotating roller, the temperature rise becomes modest compared with the temperature curve C in which the recording sheet is in close contact with the heating roller 23. That is, the temperature rise of the temperature curve D becomes modest compared with the temperature curves B and C.

In the noncontact thermistor 26 which detects the surface temperature of the heating roller 23, the case where the jammed recording sheet exists on the heating roller 23 differs from the case where the jammed recording sheet does not exist on the heating roller 23 in the temperature curve. The temperature curves A, B, and C of FIG. 5 are stored in the storage unit 57. Alternatively, a predetermined time T in which the temperature reaches a setting temperature after the start of the current conduction may be stored. In this case, the setting temperature is the fixing temperature. Alternatively, a temperature V at which a predetermined time (T) elapses after the start of the current conduction may be stored.

Thus, the case where the recording sheet winds around the heating roller as shown in FIG. 6A or 6B can be detected by storing the temperature curves A, B, and C, the predetermined time T in which the temperature reaches the setting temperature after the start of the current conduction, or the temperature V at which a predetermined time (T) elapses after the start of the current conduction.

FIGS. 6A and 6B show the case where the whole recording sheet winds around the heating roller 23. On the other hand, the temperature curve becomes the temperature curve C or D or a curve between the temperature curves C and D in the case where the recording sheet is torn in removing the jam and a part of the recording sheet winds around the heating roller 23.

Figure 7:
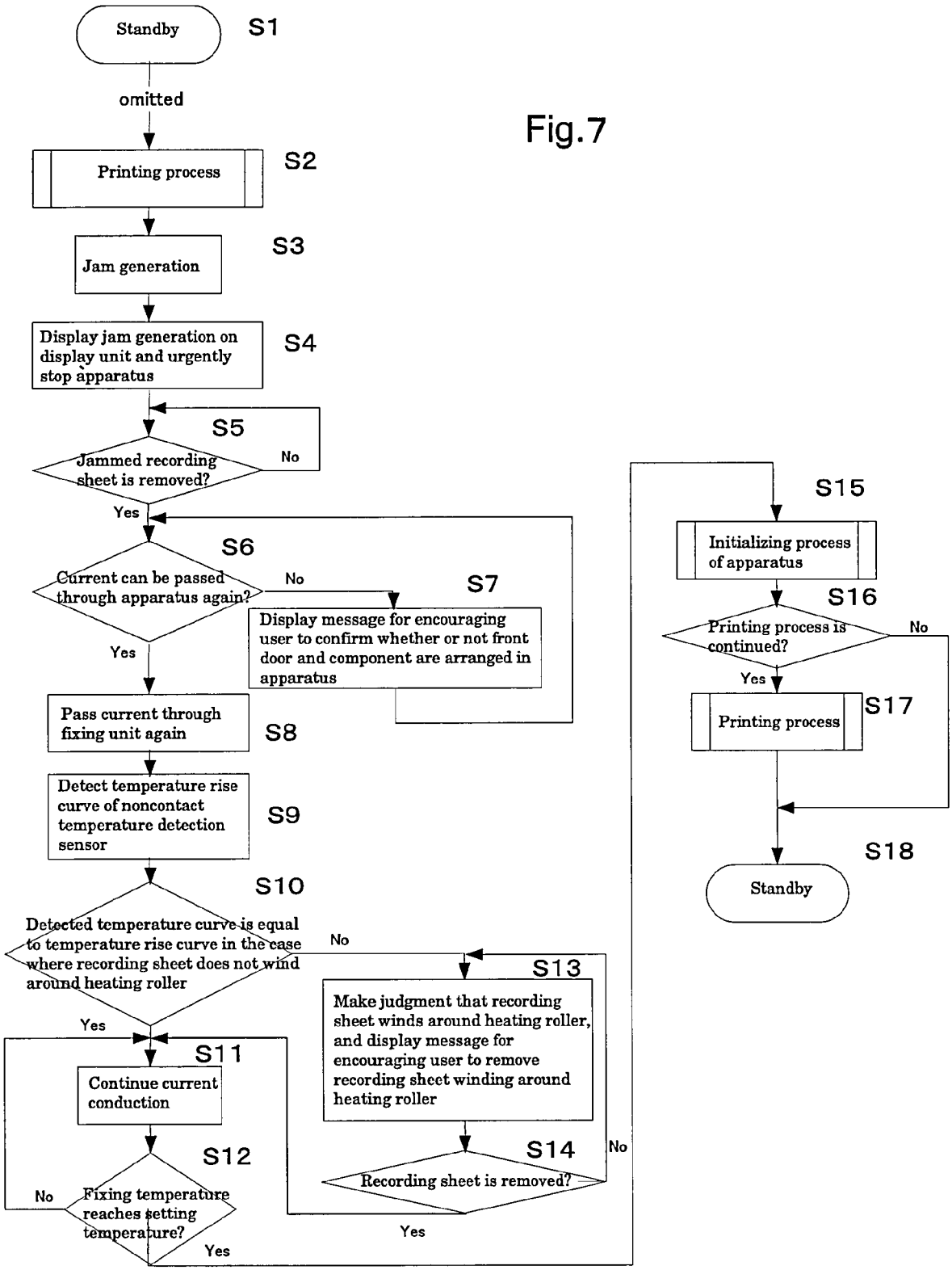
FIG. 7 is a flowchart explaining an operation of the fixing device according to the invention.

FIG. 7 is a flowchart explaining an operation of the fixing device of the embodiment. The CPU 51 executes the program stored in the storage unit 57 to perform the flowchart.

Initially, the image forming apparatus is in a standby state (Step S1). When the original is read or print data is received, the image forming apparatus performs the printing process (Step S2). Although the image forming apparatus performs various operations between Steps S1 and S2, the detailed description will be omitted. When the jam is generated during the printing process (Step S3), the CPU 51 detects the jam, the image forming apparatus displays the jam generation on the display unit 59, and the image forming apparatus is urgently stopped (Step S4). The urgent stop of the image forming apparatus cuts off the passage of the current through the main heater 28, the sub-heater 42, and the external heater 44, and the motor 54 which drives the heating roller 23 is also stopped. Therefore, the noncontact thermistor 26 detects the temperature fall as shown by the temperature curve A.

When the jammed recording sheet is removed by the user, the CPU 51 judges whether or not the jammed recording sheet is removed (Step S5). Then, the CPU 51 judges whether or not the current can be passed again (Step S6). When the CPU 51 judges that the current cannot be passed again in Step S6, the image forming apparatus displays a message for encouraging the user to confirm whether or not the front door is closed and to confirm whether or not the conveyance belt and the fixing unit is correctly returned to the original position on the display unit 59 (Step S7). When the CPU 51 judges that the image forming apparatus can be restarted in Step S6, the current is passed through the main heater 28, the sub-heater 42, the external heating roller heater 44, and the motor 54 again (Step S8). Then, the CPU 51 obtains the information on the temperature detected by the noncontact thermistor 26 (Step S9). The detected temperature information may be the temperature change curves B to D, or the detected temperature information may be the predetermined time T in which the temperature reaches the setting temperature after the start of the current conduction or the temperature V at which a predetermined time elapses after the start of the current conduction. The judgment unit 58 judges whether or not the detected temperature information is equal to the information on the temperature in which the no recording sheet winds around the heating roller 23 (Step S1). When the judgment unit 58 judges that the detected temperature information is equal to the information on the temperature in which the no recording sheet winds around the heating roller 23, the current is continuously passed to normally operate the image forming apparatus (Step S11). Then, it is judged whether or not the heating roller 23 reaches the setting temperature, and the control is performed such that the heating roller 23 is maintained at the setting temperature (Step S12).

When the judgment unit 58 judges that the detected temperature information is equal to the information on the temperature in which the no recording sheet winds around the heating roller 23 in Step S10, the current conduction is stopped, and it is judged that the recording sheet winds around the heating roller 23, the message for encouraging the user to removed the recording sheet winding around the heating roller 23 is displayed on the display unit 59 (Step S13). Then, it is judged whether or not the recording sheet winding around the heating roller 23 is removed (Step S14). When it is judged that the recording sheet is removed, the flow goes to Step S11. When it is judged that the recording sheet is not removed, the flow returns to Step S13.

In Step S12, when the heating roller 23 reaches the fixing temperature, the image forming apparatus performs an initializing process (Step S15). Then, it is judged whether or not the image forming apparatus continues the printing process (Step S16). When it is judged that the image forming apparatus continues the printing process, the printing process is performed in the next step (Step S17). When it is judged that the image forming apparatus does not continue the printing process, the flow goes to Step S18, and the image forming apparatus becomes the standby state.

Thus, in the restart after the jam generation, it is judged whether the recording sheet winds around the heating roller, and the fixing device is restarted when the recording sheet does not wind around the heating roller. Therefore, the fixing device can safely be restarted.

It should be apparent to those skilled in the art that the present invention may be embodied in many other specific forms without departing from the spirit or scope of the invention. Therefore, the present invention is not to be limited to the details given herein, but may be modified within the scope and equivalence of the appended claims.

What is claimed is:

1. A fixing device comprising:

a pair of rotating bodies which conveys a recording medium between a nip at which said rotating bodies are pressed against each other;

a heating unit which heats at least one of said rotating bodies;

a temperature detection unit which detects a temperature of at least one of said rotating bodies;

a storage unit in which a temperature change is stored, the temperature change representing the change in temperature of the at least one of said rotating bodies in the case where an image forming apparatus is operating normally when the imaging forming apparatus is restarted after the occurrence of a jam;

a judgment unit which judges that the image forming apparatus is in an abnormal state when said temperature detection unit detects a temperature change different from the temperature change in the case of said normal operation; and a temperature control unit which stops passage of current through said heating unit when said judgment unit judges that the image forming apparatus is in the abnormal state.

2. A fixing device according to claim 1, further comprising a drive control unit which stops rotation of said rotating bodies when said judgment unit judges that the image forming apparatus is in the abnormal state.

3. A fixing device according to claim 1, wherein said temperature detection unit is a noncontact temperature detection unit which is placed near at least one of said pair of rotating bodies.

4. A fixing device according to claim 1, wherein said temperature detection unit is arranged in the substantial center of a region where the maximum recording sheet is conveyed between the nip of said pair of rotating bodies.

5. A fixing device according to claim 1, wherein said temperature detection unit is arranged in a sheet non-passing region except for the region where the maximum recording sheet is conveyed between the nip of said pair of rotating bodies.

6. A fixing device according to claim 1, wherein said temperature detection unit causes said temperature control unit to control said rotating bodies based on detection output of said temperature detection unit such that said rotating bodies is maintained at a predetermined temperature.

7. A fixing device according to claim 1, further comprising a display unit which displays the abnormality or provides warning when said judgment unit judges that the image forming apparatus is in the abnormal state.

8. A fixing device according to claim 1, wherein the temperature change until the image forming apparatus is normally operated is temperature rise since said heating unit starts the heating again after the rotation of said pair of rotating bodies is stopped to stop the passage of the current through the heating unit.

9. A fixing device according to claim 1, wherein the temperature rise in the case where the recording sheet winds around the rotating bodies while coming into close contact with the rotating bodies and the temperature rise in the case where the recording sheet winds around the rotating bodies while partially isolated from the rotating bodies are stored in said storage unit.

10. An image forming apparatus comprising a fixing device as in claim 1.

11. A fixing device according to claim 3, wherein said temperature detection unit is a noncontact temperature detection unit which is placed near at least one of said pair of rotating bodies.

* * * * *